US007107741B2

(12) United States Patent
Monti

(10) Patent No.: US 7,107,741 B2
(45) Date of Patent: Sep. 19, 2006

(54) METHOD AND APPARATUS FOR SELECTING AND FEEDING ARTICLES

(75) Inventor: Giuseppe Monti, Bologna (IT)

(73) Assignee: Marchesini Group S.p.A., Bologna (IT)

( * ) Notice: Subject to any disclaimer, the term of this patent is extended or adjusted under 35 U.S.C. 154(b) by 145 days.

(21) Appl. No.: 10/616,642

(22) Filed: Jul. 10, 2003

(65) Prior Publication Data

US 2004/0007442 A1 Jan. 15, 2004

(30) Foreign Application Priority Data

Jul. 12, 2002 (IT) ..... BO2002A0449

(51) Int. Cl.

| | |
|---|---|
| ***B65B 3/24*** | (2006.01) |
| ***B65B 5/10*** | (2006.01) |
| ***B65B 1/30*** | (2006.01) |
| ***B65B 3/26*** | (2006.01) |

(52) U.S. Cl. ..... 53/475; 53/54; 53/55; 53/237; 53/250; 53/500; 53/501; 53/504; 53/443

(58) Field of Classification Search ..... 53/500, 53/54, 55, 147, 244, 250, 501, 237, 238, 53/504, 475, 443, 473; 209/616

See application file for complete search history.

(56) References Cited

U.S. PATENT DOCUMENTS

| | | | | | |
|---|---|---|---|---|---|
| 3,837,139 | A * | 9/1974 | Roseberg | 53/501 |
| 3,977,483 | A * | 8/1976 | Greanias | 177/1 |
| 4,174,780 | A * | 11/1979 | Farrar et al. | 209/536 |
| 4,953,711 | A * | 9/1990 | Focke | 209/535 |
| 5,081,816 | A * | 1/1992 | Cardinali | 53/54 |
| 5,369,940 | A * | 12/1994 | Soloman | 53/501 |
| 5,522,512 | A * | 6/1996 | Archer et al. | 209/580 |
| 5,638,657 | A * | 6/1997 | Archer et al. | 53/253 |
| 5,703,784 | A * | 12/1997 | Pearson | 700/223 |
| 5,732,147 | A * | 3/1998 | Tao | 382/110 |
| 5,799,468 | A * | 9/1998 | Eck et al. | 53/453 |
| 5,917,927 | A * | 6/1999 | Satake et al. | 382/110 |
| 5,966,910 | A * | 10/1999 | Ribani et al. | 53/560 |
| 6,311,743 | B1 * | 11/2001 | Baroncini | 141/234 |
| 6,345,487 | B1 | 2/2002 | Smith | |
| 6,481,180 | B1 * | 11/2002 | Takahashi et al. | 53/237 |

FOREIGN PATENT DOCUMENTS

| | | |
|---|---|---|
| DE | 140 245 C | 1/1902 |
| DE | 21 25 666 A | 12/1971 |
| EP | 0 334 825 A | 9/1989 |

* cited by examiner

*Primary Examiner*—Rinaldi I. Rada
*Assistant Examiner*—Christopher Harmon
(74) *Attorney, Agent, or Firm*—William J. Sapone; Coleman Sudol Sapone P.C.

(57) ABSTRACT

According to a method for selecting and feeding articles to blisters or containers, a first hopper filled with unselected articles feeds a second main hopper with selected size-matching articles, by means of a tapered inlet section. Size non-matching articles get jammed and stopped within the tapered inlet sections and are removed by means of a shutter hinged to each inlet section. A sensor detects when the flow of size-matching articles is interrupted. According to a second embodiment the inlet sections are replaced by swinging tubular portions. The shutters and tubular portions can be operated cyclically, thus avoiding the need for the sensor. An apparatus is also described for carrying out the method.

21 Claims, 5 Drawing Sheets

FIG.5a
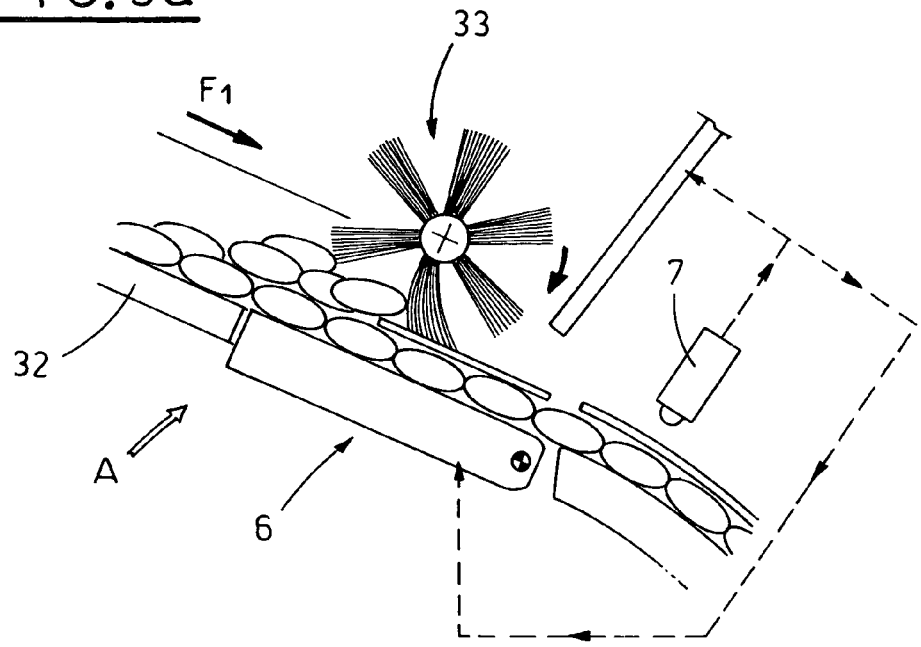
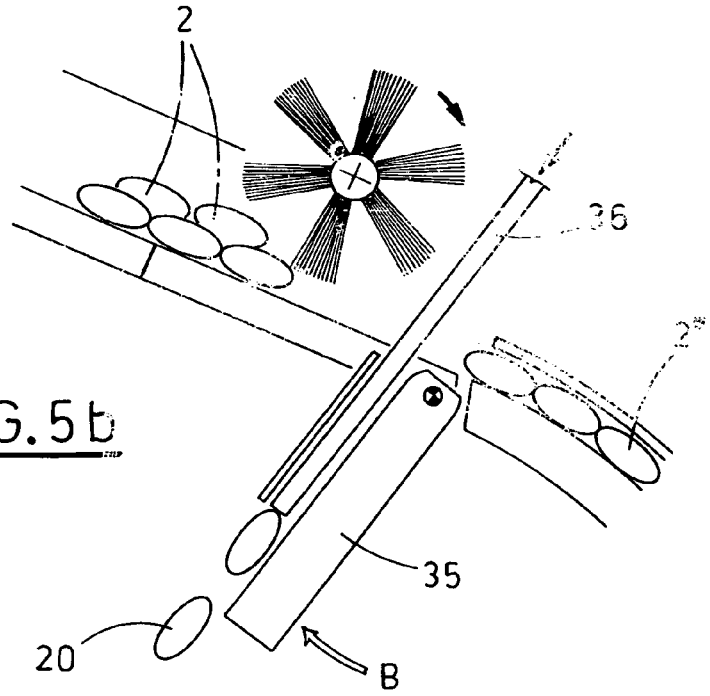
FIG.5b

METHOD AND APPARATUS FOR SELECTING AND FEEDING ARTICLES

FIELD OF THE INVENTION

The present invention relates to automatic packaging of various articles, in particular pharmaceuticals but preferably food or pharmaceutical-like articles, such as candies, chewing-gum and the like. These articles can be packed into blister packs but also in other kind of packages which are feed by devices similar to the ones used to fill blister packs.

In particular, the present invention relates to a method for selecting and feeding such articles, and to an apparatus capable of carrying out this method.

BACKGROUND OF THE INVENTION

Currently used packs, commonly called "blister packs", or similar containers, such as bottles, small boxes, and so on, are filled in a filling station, where at least one article is introduced into each blister or a series of articles are filled to each bottle or each box.

In the following, reference will be more often made only to the blister-packaging method. However, it should be understood that the invention, as well as all considerations made herein below, apply mostly also to packaging articles into bottles or boxes or other similar containers, as long as the feeding method and apparatus used are the same or very similar.

The known apparatuses for filling the blisters, according to different techniques, are particularly efficient and reliable for high quality articles, such as pharmaceutical or pharmaceutical-like products, that is for articles, whose dimensions are very homogeneous.

However, feeding articles having substantially different dimension, can be particularly difficult.

Typically, the blister filling apparatuses known to those skilled in the art, and often similar devices for filling bottles and boxes as well, include a plurality of feeding channels, along which the articles are taken in rows to the blisters, for instance made in a band, or to the bottles or boxes.

The lower ends of the channels touch the band surface and the articles are fed into the respective blisters, as they pass therebelow.

The channels are connected in parallel with a feeding device, e.g. a vibrating hopper, inside which the articles are contained in bulk.

The hopper vibrations, of prefixed amplitude and frequency, facilitate a systematic introduction of the articles into each channel.

As already mentioned, in case of high quality articles, which all match perfectly the required size, all articles pass freely through the channels and enter the blisters each time underlying, without creating jams inside the channels and allowing a substantially continuous and regular flow therein.

In case of lower quality articles, e.g. for alimentary use (chewing gum, candies, etc.), the hopper can contain articles which do not match perfectly the nominal size and can provoke jams and obstacles in the channels, usually in their inlet area. This fact negatively affects the flow of articles being fed to the containers.

The jams and obstacles can be caused by articles, whose dimensions are not compatible with the channels sections, or by articles sticking together, which thus form groups.

Typically, the articles placed in bulk in the hopper after a selection or they are selected as they are fed to the containers. However, generally only one hopper is provided and the selection causes a temporary interruption of the flow of articles. The article flow interruption may provoke either missing articles in the containers or delay in the package operation. Sometimes, it can even require the machine to be stopped, all this resulting in considerable downtime.

SUMMARY OF THE INVENTION

The object of the present invention is to propose a method for selecting and feeding articles, which ensures that interruptions of the flow of articles being fed or any jam are avoided, no matter of the shape and dimensions of the articles.

Another object of the present invention is to propose a method characterized by particularly simple operation steps, which do not require complicated and/or expensive devices for carrying them out.

A further object of the present invention is to propose an apparatus capable of preventing any jam and/or obstruction of the channels feeding the above mentioned articles, independently from their shape and dimensions.

A still further object of the present invention is to propose an apparatus which ensures high reliability and productivity standards in any operation conditions without changing in any way the functionality of the whole unit.

The above mentioned objects are obtained, in accordance with the contents of the claims, by means of a method for selecting and feeding articles to blister packs or containers, from a main hopper, filled with articles, the method including:

providing an auxiliary hopper filled with unselected articles;

feeding said main hopper with articles taken from said auxiliary hopper through selecting means stopping size-non-matching articles;

removing, from said selecting means the size-non-matching articles stopped therein or thereby to restore a regular article feeding flow;

feeding said blister packs or containers with size-matching articles contained in said main hopper.

The method herein referred to is carried out by an apparatus for selecting and feeding articles to blister packs or containers, from a main hopper filled with articles, the apparatus including:

an auxiliary hopper, containing unselected articles and feeding said main hopper; and selecting means situated between said auxiliary hopper and said main hopper for stopping and removing size-non-matching articles, so that said main hopper, contains only size-matching articles for feeding said blister packs or containers.

BRIEF DESCRIPTION OF THE DRAWINGS

The characteristic features of the present invention will be pointed out in the following, where some preferred, but not exclusive embodiments are described with reference to the enclosed drawings, in which:

FIGS. 5*a* and 5*b* are lateral and enlarged views of a specially significant portion of the apparatus of FIG. 4 in two particularly significant technical-functional aspects.

DESCRIPTION OF THE PREFERRED EMBODIMENTS

Figure 1:
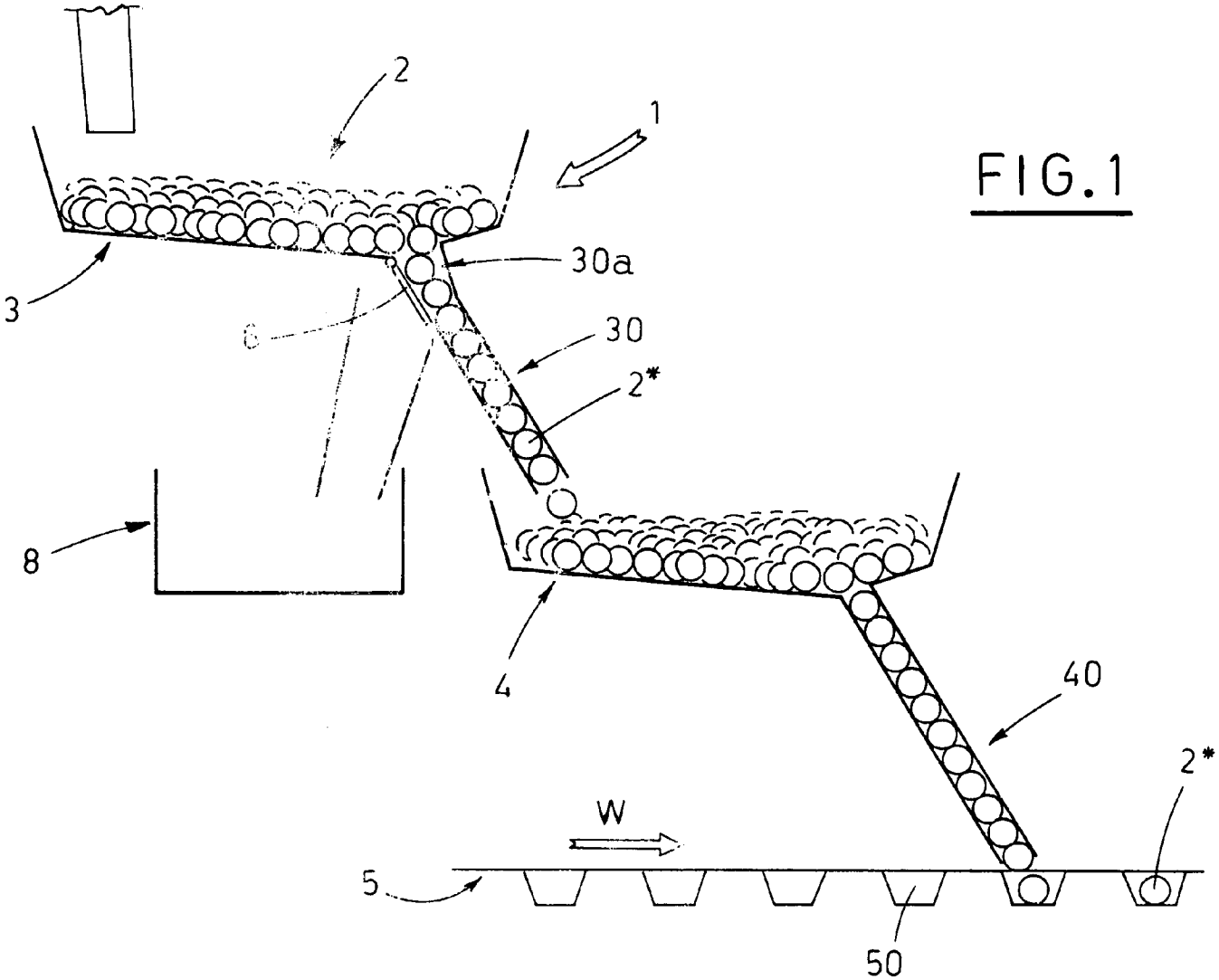
FIGS. 1, 2, 3 are schematic lateral views of an apparatus capable of carrying out the proposed method, in corresponding particularly significant operation steps.

With reference to the above drawings, the numerical reference 5 indicates, as an example, a blister band moved by conveying means of known type (not shown), in a forward direction W. It will be understood that the invention described hereinbelow, as well as all considerations made in the following, apply also to packaging articles into bottles or boxes or other similar containers, as long as the feeding method and apparatus used are the same or very similar to the ones described.

To better understand the method subject of the present invention, it is believed that an apparatus for carrying out the method is to be firstly described.

With reference to the enclosed drawings, the general reference numeral 1 indicates an apparatus for selecting and feeding articles 2 to the blister band 5, which apparatus is designed to carry out the method proposed by the invention.

The apparatus 1 includes a first hopper 3, containing non-selected articles 2 in bulk, and aimed at feeding the inlet sections 30*a* of a plurality of first channels 30, which are substantially parallel and arranged one beside another.

The non-selected articles contained in the first hopper 3 are not sorted, and some of them may not match the nominal required size of each article. It goes without saying that, in case the actual dimension of an article contained in the first hopper is smaller than the nominal size dimension, this article will not cause any problem during packaging process, in particular it will not jam within the feeding channels. In the following, size-matching articles, or calibrated articles, will indicate both articles whose dimension perfectly matches the size required and articles having dimension slightly smaller then the one required.

On the contrary, when the dimension of the article is bigger than the nominal size dimension, the feeding channel can easily get obstructed or the article can not even enter the channel, thus interrupting the feeding flow and the blister filling operation.

In the following, size-non-matching articles 20, or non calibrated articles, will in fact indicate only articles having dimension bigger than the required one.

So, the inlet section 30*a* of the first channel 30 have a gradually decreasing cross section, i.e. they form a tapered inlet section, and the narrower cross section matches the nominal section of the feeding channels 30, which allow the passage, one by one, only of size-matching articles 2*, that is articles whose dimensions matches, or is slight smaller than, the nominal dimension.

Typically, the passage of the size-matching articles through each first channel 30, is due, e.g. to gravity (FIG. 1).

Articles with bigger dimension are therefore stopped within the inlet sections 30*a*, obviously stopping also the article feeding flow.

Figure 3:
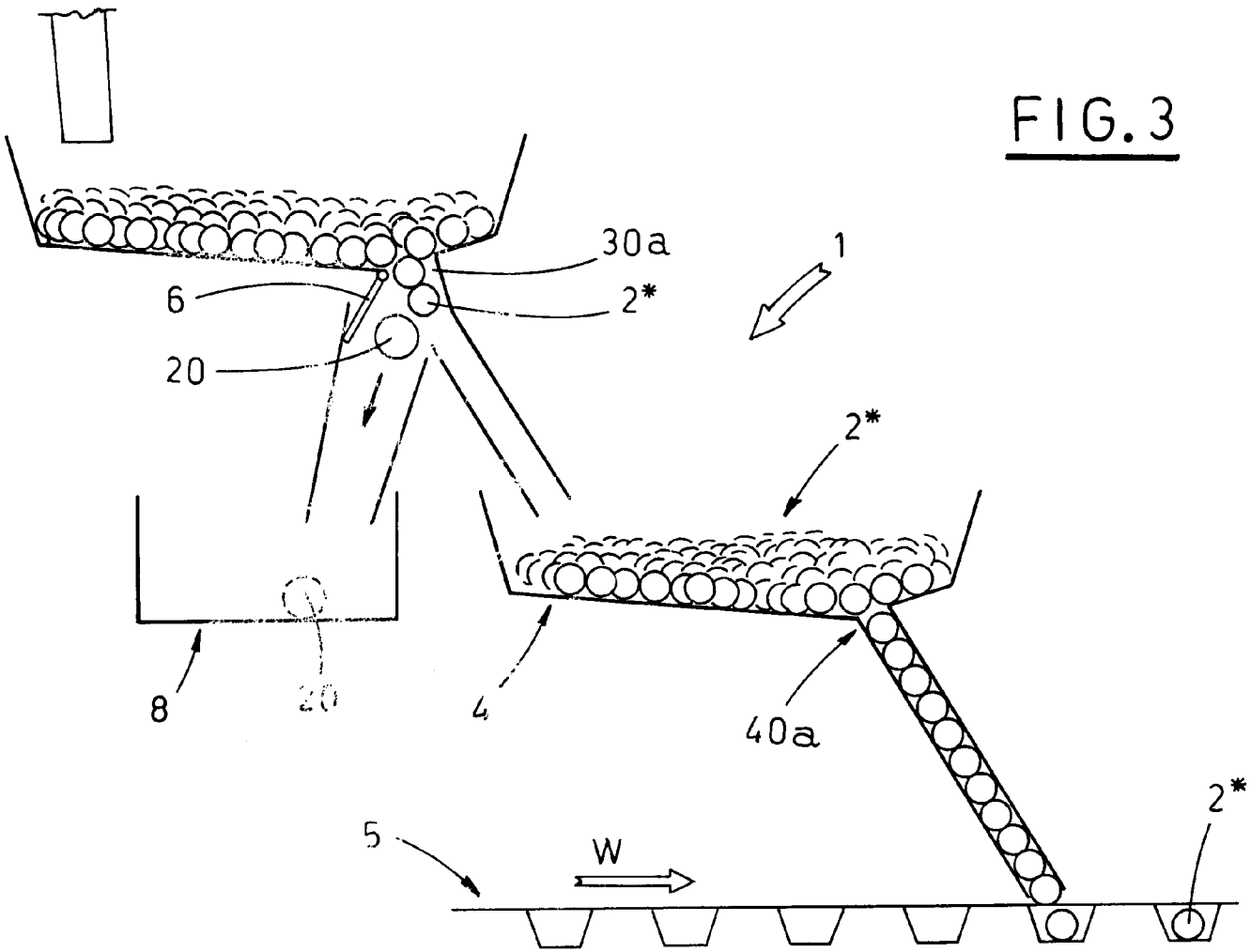

A series of shutters 6 are connected each one to a corresponding inlet section 30*a*, e.g. hinged thereto, of the first channels 30 to remove therefrom the size-non-matching articles 20, which obstruct the inlet sections 30*a* and are therefore stopped therein (FIG. 3).

The tapered inlet section 30*a* and the related shutters 3 constitute together selecting means 6, which are to remove the non-calibrated articles 20 before they are delivered to the first channels 30, and to send them to a collecting container 8.

It results that only size-matching articles, or articles with smaller dimension, are allowed to pass along the first channels 30. The first channels 30 feed a second hopper 4, containing only calibrated articles 2* in bulk, that is articles all matching the required nominal size.

The provision of the channels 30 is mode only as an example. As a matter of fact, they could be more advantageously replaced by a chute, not shown, placed just under the exit opening of the tapered inlet sections 30*a* and leading to the second hopper 4.

This because there is no need to keep the rows of articles from the first to the second hopper but in the initial path, when they run through the tapered inlet sections to be selected.

The second hopper 4 feeds the inlet sections 40*a* of a plurality of second channels 40, substantially parallel and arranged one beside another, through which all the articles 2* contained in the second hopper 4 can pass one by one, e.g. due to gravity.

Figure 2:
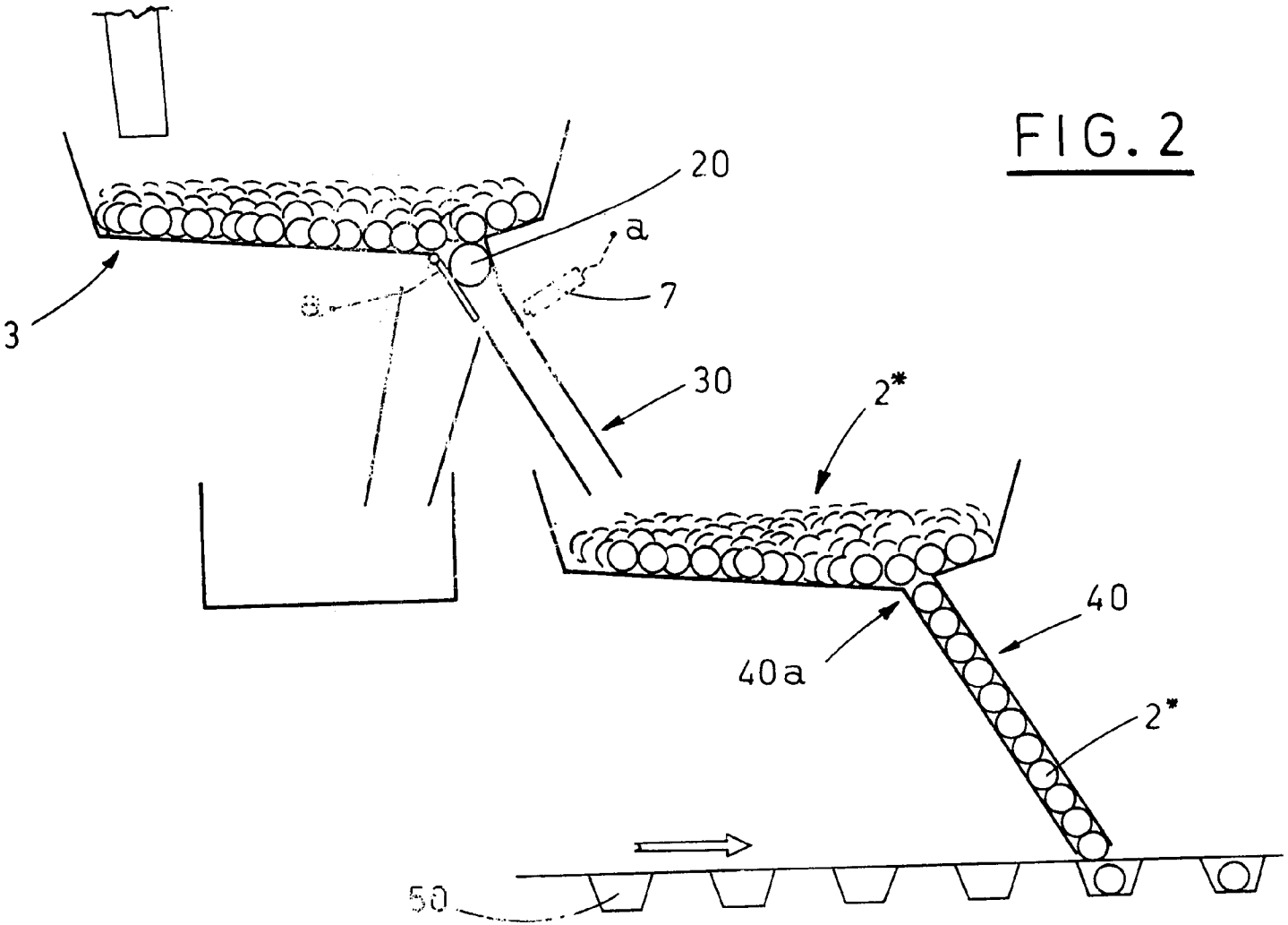

Each of the second channels 40 feeds the corresponding longitudinal row of blisters 50 (FIGS. 1, 2, 3).

Since the second hopper 4 is filled only with size-matching articles 2*, no jam will occur in the path comprised between the second hopper and the blister band, or other container.

It follows that the article flow from the second hopper to the blister band takes place smoothly, without any interruption, and all the blisters are filled with the respective products, or the bottles/boxes with the expected quantity of products.

For the operation of the selecting means 6, i.e. the shutters which co-operate with the tapered inlet sections, each first channel 30 is equipped with sensor means 7, which are situated downstream of the selecting means 6 and detects the interruption of the flow of size-matching articles 2* inside the first channel 30. When this occurs, they operate the selecting means 6 to make them remove, from the first channel 30 inlet sections 30*a*, the size-non-matching articles 20, which obstruct it (See FIG. 2).

Accordingly, the sensor means 7 co-operate with the selecting means 6 to restore the continuous and regular flow of size-matching articles 2* through the first channel 30.

Advantageously, for each inlet section 30*a* one sensor means 7 can be provided, which operate respective shutter 6.

Alternatively, a device can be provided (not shown) associated to the above mentioned selecting means 6, for cyclically operating all the shutters 6, so as remove, from each inlet section 30*a*, the size-non-matching articles 20, which possibly obstruct the inlet sections, and are therefore stopped therein, and to keep substantially continuous and regular the flow of size-matching articles 2* through the respective first channel 30. This last mentioned variation fits particularly the case in which the channels 30 are replaced with the chute, in which case the sensor 7 would be difficult to mount. Moreover, in this last case, it would be also more difficult detecting interruption of the flow of articles from each inlet section 30*a*, because of the missing rows of articles right downstream.

Figure 4:
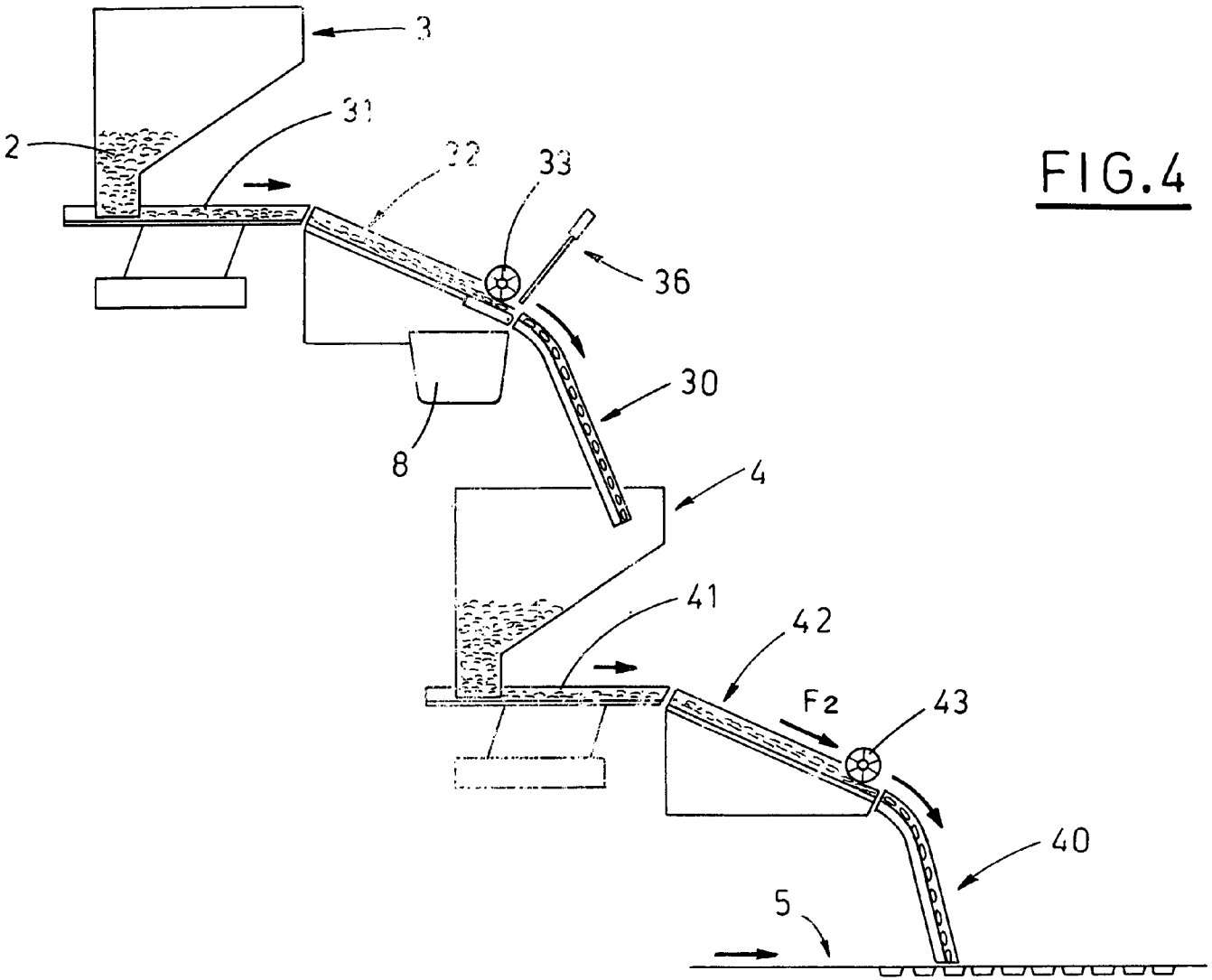
FIG. 4 is a lateral view of the proposed apparatus according to another embodiment.

With reference to FIGS. 4, 5*a* and 5*b*, according to another embodiment of the selecting means, the first hopper 3 feeds the inlet sections 30*a* of the first channels 30 by means of a first substantially horizontal linear vibrating conveyor 31, which conveys the articles 2 onto a selector 32, which is inclined and leads to the inlet sections 30*a*.

In this case, the selecting means 6 are advantageously formed by tubular portions 35, which are hinged to the inlet sections 30*a* of each first channel 30, and whose dimensions are similar to the latter, as far as the passage section is concerned.

Near the inlet sections 30*a*, and above the tubular portions 35, there are first rotating means 33, e.g. a brush, associated to the selector 32.

The brush 33 draws back, with respect to the movement direction F1 (FIG. 5*a*), the articles 2, which are not correctly oriented and do not enter the tubular portions 35, thus maintaining at the inlet sections 30*a* a single feeding layer of articles 2, which are then introduced into the first channels 30.

Also size-non-matching articles 20 are prevented from entering the tubular portions 35 or, if they anyway enter therein, becomes jammed and stopped at an intermediate point of the same tubular portions 35. More generally, as it can be seen in FIG. 5*a*, articles slightly bigger than the nominal size will get stopped by the inlet opening of the tubular portions ad remain stopped in that position.

To help performing this actions, also the tubular portions 35 may have a taper-like cross section.

The tubular portions 35 are hinges so as to rotate from a normal operation configuration A, in which they remain aligned with the first channels 30, sending the flow of article into the latter, to a discharge configuration B, in which the tubular portions 35 are no longer aligned with the relative first channels 30.

Ejection means 36 are situated near the inlet sections 30*a* of the first channels 30 to interact with the respective tubular portions 35 when they are in the discharge configurations B, so as to enter the tubular portion, preferably from the outlet side, to remove the articles situated therein.

Advantageously, the ejecting means 36, preferably operated by pneumatic cylinders, engage the tubular portions 35 running coaxially therewith (FIG. 5*b*).

Therefore, articles jammed within the tubular portions 35 or just resting against the inlet of the tubular portions 35, which articles do not match the required size, are discharged into the collecting container 8.

During the time interval corresponding to the removal of the size-non-matching articles 20 from the tubular portions 35, that is in the time corresponding to the movement of the tubular portions 35 from the normal operation configurations A to the discharge configurations B, and then again to the normal operation configurations A, all the articles 2 coming from the first linear vibrating conveyor 31 are conveyed indifferently to the collecting container 8. Providing a brush sufficiently rigid, the articles 2 coming along the first linear vibrating conveyor 31 are refrained from continuing their motion and prevented from falling into the collecting container. When the tubular portions are moved back to their normal operation configuration A, the brush bristles bend and rub on the upper surface of the tubular portions 35, thus keeping on their normal duty.

The tubular portions 35 of each first channel 30, and the ejecting means 36 associated thereto, can be operated singularly or all together at the same time, by a single command.

In case of singular operation of each of the ejecting means 36, also the corresponding tubular portions 35 are operated singularly and selectively when they receive a suitable command from the corresponding sensor means 7, associated thereto, as in the case of the embodiment firstly described.

In case of contemporary operation of all the pneumatic ejecting means 36, also all the tubular portions 35 would be operated contemporarily by a single command from the normal operation configurations A to the discharge configurations B and vice-versa.

Only in case, in which all the tubular portions 35 are operated contemporarily and move to the discharge configurations B, the feeding from the first hopper 3 to the first linear vibrating conveyor 31 is to be cut off, so as to limit the number of articles 2 conveyed to the collecting container 8.

Still with reference to the embodiment proposed in FIGS. 4, 5*a* and 5*b*, the second hopper 4 feeds the inlet sections 40*a* of the second channels 40 by means of a second substantially horizontal linear vibrating conveyor 41, which conveys size-matching articles 2* to an inclined loader 42 leading to the inlet sections 40*a*.

Since the second hopper 4 is filled only with size-matching articles 2*, no jam will occur in the path comprised between the second hopper and the blister band. It follows that the article flow from the second hopper to the blister band takes place smoothly, without any interruption, and all the blisters are filled with the respective products.

Near the inlet sections 40*a*, the loader 42 there are provided second rotating means 43, situated thereabove substantially similar to the first ones 33, e.g. a brush.

The brush 43 draws back, with respect to the forward movement direction F2, the size-matching articles 2*, which are not correctly oriented with respect to the inlet sections 40*a*, thus maintaining, near the inlet sections 40*a*, a single feeding layer of articles 2*, which are introduced into the second channels 40.

Also in this case, the first channels 30 can be replaced by a chute, preferably providing an automatic cyclic operation of the selecting means, as in the first embodiment mentioned above.

For both the embodiments described the following should be noted.

In order to ensure the presence of a minimum quantity of size-matching articles 2* inside the second hopper 4, taking into consideration statistical lacks in feeding thereof due to the obstruction of one or more inlet sections 30*a* of the first channels 30, or due to operation of the tubular portions 35 when they are moved to the discharge configuration B, the flow rate of articles 2 through the first channels 30 is higher than the flow rate of size-matching articles 2* through the second channels 40, so as to obtain a continuous feeding of each longitudinal row of blisters 50 of the band 5.

Anyhow, in order to maintain always a minimum level of calibrated articles 2* inside the second hopper 4, the latter is equipped with suitable detectors of known type (not shown), which are situated near the bottom thereof, and which can supply a minimum level alarm signal.

Likewise, in order to assure a correct operation of the proposed apparatus 1, the second hopper 4 can be equipped with suitable detectors of known type (likewise not shown), which define a maximum level of the calibrated articles 2* present inside the second hopper 4, by acting on the feeding of the first channels 30.

The operation of the apparatus 1, which carries out the proposed method, will be described in the following, beginning from an operation condition, in which the size-matching articles 2* pass through the first channels 30 and the selecting means 6 are disabled.

When the sensor means 7, connected to a first channel 30, detect the interruption of the articles 2 flow thereinside, due to a size-non-matching articles 20 stopped within one of the inlet section 30*a*, they operate the relevant selecting means 6, in such a way to remove the obstruction, which has caused the interruption of the articles 2 flow.

Operation of the selecting means 6 allows to remove, from the corresponding inlet section 30*a*, the size-non-matching articles 20 obstructing the passage, and to send them to the collecting container 8, thus restoring the flow of calibrated articles 2* inside the first channel being involved.

This way, each first channel 30 is passed through only by size-matching articles 2* which are accumulated in the second hopper 4, situated therebelow.

The calibrated articles 2* present in the second hopper 4 are introduced, without causing any jam or obstacle, into second channels 40 to feed continuously the blisters of the corresponding longitudinal rows of blisters 50 of the band 5.

From the above description of the apparatus, the proposed method for selecting and feeding articles to a blister band 5 can readily be understood.

The method includes substantially the following operation steps:

- Articles 2, contained in a first hopper 3, are fed to selecting means, through which only size-matching articles 2* may pass one by one (FIG. 1);
- Size-non-matching articles 20, that is articles having a dimension bigger than the dimension allowing the article to pass through said first channels 30, as well as the second channel 40, are stopped within said selecting means 6;
- The jammed size-non-matching articles 20 stopped within the selecting means 6 are removed therefrom, thus restoring normal flow condition for the articles;
- A second hopper 4 is fed only with size-matching articles 2*;
- The size-matching articles 2*, contained in the second hopper 4, are fed to the inlets 40*a* of a plurality of second channels 40, aimed at allowing the calibrated articles 2* to pass one by one, to feed the blisters of each longitudinal row of blisters 50 underlying the respective second channel 40.

Briefly, the method provide for a in-line sort operation of defective articles by using the negative effect due to the defective articles themselves.

According to the method, articles which would not pass freely along the feeding channels or would not enter the blisters or would not properly fill any other relevant container are trapped by the selecting means due to their non-matching dimension and then removed from the flow of articles.

The selection means may be formed, as mentioned in the description of the apparatus, by tapered inlet sections 30*a* and associated shutters, or by swinging tubular portions 35.

The size-non-matching articles 20 removed from the inlet sections 30*a* or tubular portions 35 are advantageously delivered to a collecting container 8 (FIG. 3). Since also size-matching articles 2* are inevitably removed from the inlet sections 30*a* and tubular portions 35 along with the size-non-matching articles 20, they are sorted from the collecting container and then recycled.

The removal of the articles jammed in the inlet sections 30*a* or tubular portions 35, thus obstructing them and stopping the article feeding flow, can be operated as a result of a flow verify operation performed on the flow of the calibrated articles 2* passing in each first channel 30.

Sensor means 7 detects the interruption of the flow in the channel 30 and, subsequently, operate ejecting means to remove the non-calibrated articles 20, which obstruct the inlet sections 30*a* and would also obstruct the first channel 30, in order to restore the continuous and regular flow of said calibrated articles 2* through each first channel 30 (FIG. 2).

Otherwise, it is possible to remove cyclically the non-calibrated articles 20, which may have obstructed the inlet sections 30*a*, in order to restore the continuous and regular flow of the calibrated articles 2* through each first channel 30, in those case in which the flow was interrupted. This is preferable where the first channels are replaced by a chute leading to the second hopper.

In order to ensure a minimum quantity of calibrated articles 2* inside the second hopper 4, taking into consideration statistical lacks in feeding thereof due to the obstruction of the first channels 30, the feeding the first channels 30 provides a flow rate of articles 2 higher than the flow rate of size-matching articles 2* performed by the second channels 40, so as to ensure a continuous feeding of articles to the blisters 50 of the band 5 or to the containers.

The articles 2, 2*,20, which have been taken into consideration, may include pills, capsules, tablets for pharmaceutical, but preferably pharmaceutical-like or alimentary use.

The proposed method for selecting and feeding articles to a blister band is particularly suitable for processing any kind of articles, and is extremely indicated for food articles, gum-like ones, e.g. chewing gum and candies, etc.

The sequence of operation steps is particularly simple and does not require complicated and/or expensive devices. The apparatus ensures a perfect filling of each blister with only one article, thus avoiding any interruption of feeding flow of articles, independently from the shape and dimensions of articles themselves.

The proposed apparatus for carrying out the method proposed by the present invention, ensures high reliability and productivity standards in any working conditions.

The selecting means provided near the first channels, advantageously situated near their inlet sections and operated cyclically or on command of sensor means, remove non-calibrated articles, i.e. size-non-matching articles, which obstruct the inlet sections, thus ensuring a substantially continuous and regular flow of calibrated articles, i.e. size-matching articles, to the second hopper.

It is also to be pointed out that the number of elements of the apparatus proposed by the present invention is limited and they are simple to produce, which advantageously reduces the dimensions and the production costs, which therefore remain low.

Obviously, the proposed invention has been described, with reference to the enclosed figures, as a pure not limiting example, and therefore it is understood that all changes and variants remaining within the inventive scope defined by the following claims, can be applied thereto.

What is claimed is:

1. A method for selecting and feeding articles to blister packs or containers, from a main hopper, filled with articles, the method comprising:

- providing an auxiliary hopper filled with unselected articles;
- providing selecting means for allowing free passage of size-matching articles or of articles smaller than a nominal size of said size-matching articles for feeding said main hopper, while stopping size-non-matching articles whose dimensions are bigger than said nominal size,
- feeding said main hopper with articles allowed free passage by said selecting means from said auxiliary hopper,
- passing size-matching articles through the selecting means and stopping size-non-matching articles within tubular portions of said selecting means and swinging the tubular portions downwardly to remove the size non matching articles to maintain a regular article feeding flow;

feeding said blister packs or containers with the size-matching articles contained in said main hopper, wherein the size-non-matching articles passing through the selecting means are stopped due to interception performed by the tubular portions of said selecting means having an inner section matching the nominal size of the articles, so as to stop such size-non-matching articles.

2. A method, according to claim 1, further including checking presence of articles forming a flow of articles through first channels connected to said selecting means, and operating said selecting means upon detection of the flow having being interrupted, to remove size-non-matching articles and restore said flow of size-matching articles through said first channels.

3. A method, according to claim 1, further including cyclical operation of said selecting means to remove size-non-matching articles possibly stopped within or by said selecting means, to keep a continuous flow of size-matching articles.

4. A method, according to claim 1, wherein said selecting means are fed with an article flow rate higher than the flow rate of size-matching articles fed to said blisters or containers, so as to allow said size-matching articles to accumulate in said main hopper and a continuous feeding of articles to the blisters or containers.

5. A method according to claim 1, characterized in that the articles removed from said selecting means are collected in a collecting container to be sorted and recycled.

6. An apparatus for selecting and feeding articles to blister packs or containers, from a main hopper filled with articles, the apparatus comprising:

an auxiliary hopper, containing unselected articles for feeding said main hopper; and selecting means, situated between said auxiliary hopper and said main hopper, having an inlet side, to receive said unselected articles, and an outlet side, to exit selected articles, said selecting means being provided with a cross section matching a nominal size of selected articles to provide size-matching articles which are fed to said main hopper, the selecting means allowing free passage of the size-matching articles or of articles smaller than said nominal size, and stopping for removal size-non-matching articles, so that said main hopper contains only size-matching articles for feeding said blister packs or containers, said selecting means including at least one tubular portion having an inlet side and an outlet side, having internal dimension matching the nominal size of said articles, said tubular portion moving from one normal operation configuration, in which in which a flow of articles is allowed to pass, to a discharge configuration, in which the tubular portion is rotated to discharge size-non-matching articles jammed and stopped within said tubular portion or against said inlet side of said tubular portion, and further including ejecting means for interacting with said tubular portion, when in the discharge configuration, from the outlet side, so as to remove the articles present therein or stopped by said inlet side.

7. An apparatus, according to claim 6, further including first brush type rotating means, connected to and situated above said tubular portions for drawing back, with respect to the forward movement direction, unselected articles not correctly oriented with respect to said tubular portions during normal feeding of the articles, thus maintaining a single feeding layer of the articles introduced into said tubular portion.

8. An apparatus, according to claim 7, wherein, when the tubular portions are set in their discharge configuration, said first brush type rotating means refrain said unselected articles from continuing their motion and being removed.

9. An apparatus, according to claim 6, further including sensor means, situated along said selecting means for detecting possible interruption of a flow of articles and for operating said selecting means, so as to remove size-non-matching articles stopped within said selecting means or by said selecting means.

10. An apparatus, according to claim 6, wherein said selecting means are operated cyclically to remove size-non-matching articles possibly stopped within said selecting means or by said selecting means, and to restore a continuous flow of size-matching articles.

11. An apparatus according to claim 6, including a chute connected to said selecting means and leading to said main hopper.

12. An apparatus, according to claim 11, wherein said selecting means are operated cyclically to remove size-non-matching articles possibly stopped within said selecting means or by said selecting means, and to restore a continuous flow of size-matching articles.

13. An apparatus, according to claim 6, further including a first linear vibrating conveyor situated downstream of said auxiliary hopper, for feeding unselected articles to a selector, which is substantially inclined and leads to said selecting means.

14. An apparatus, according to claim 6, wherein said ejecting means are operated by pneumatic cylinders.

15. An apparatus, according to claim 6, wherein the flow rate of unselected articles fed to said selecting means is higher that the flow rate of size-matching articles fed to said blisters or containers, so as to allow said size-matching articles to accumulate inside said main hopper.

16. An apparatus, according to claim 6, wherein when the selecting means are operated, the discharged articles are sent to a collecting container.

17. An apparatus for selecting and feeding articles to blister packs or containers, from a main hopper filled with articles, the apparatus comprising:

an auxiliary hopper, containing unselected articles for feeding said main hopper; and selecting means, situated between said auxiliary hopper and said main hopper, having an inlet side, to receive said unselected articles, and an outlet side, to exit selected articles, said selecting means being provided with a cross section matching a nominal size of selected articles to provide size-matching articles which are fed to said main hopper, the selecting means allowing free passage of the size-matching articles or of articles smaller than said nominal size, and stopping for removal size-non-matching articles, so that said main hopper contains only size-matching articles for feeding said blister packs or containers;

at least one first channel connected to said selecting means and leading to said main hopper, said selecting means include a tapered inlet section for each first channel and a shutter connected to said tapered inlet section, said shutter opened to discharge jammed and stopped articles;

a first linear vibrating conveyor situated downstream of said auxiliary hopper, for feeding unselected articles to a selector, which is substantially inclined and leads to said selecting means; and, further including a second substantially horizontal linear vibrating conveyor situated downstream of said main hopper for feeding size-matching articles to a loader leading to said blisters or containers.

18. An apparatus, according to claim 17, further including second brush type rotating means connected to and situated above said loader, for drawing back, with respect to the movement forward direction, the size-matching articles not correctly oriented, thus maintaining a single feeding layer of size-matching articles fed to said blister packs or containers.

19. An apparatus, according to claim 17 further including sensor means, situated downstream of said selecting means for detecting the continuity of flow of articles into said first channel and for operating said selecting means, so as to remove size-non-matching articles stopped within said selecting means or by said selecting means.

20. An apparatus, according to claim 17, further including a plurality of second channels, substantially parallel and arranged one beside another, fed by said main hopper, for feeding size matching articles to said blisters or containers.

21. An apparatus, according to claim 17, including a plurality of first channels, substantially parallel and arranged one beside another, fed by said auxiliary hopper and leading to said main hopper, and a plurality of second channels, substantially parallel and arranged one beside another, fed by said main hopper, for feeding size matching articles to said blisters or containers.

* * * * *